US009199290B2

(12) United States Patent
Yabuta et al.

(10) Patent No.: US 9,199,290 B2
(45) Date of Patent: Dec. 1, 2015

(54) SQUEEZE ROLL STAND

(75) Inventors: Hiroaki Yabuta, Osaka (JP); Feizhou Wang, Osaka (JP); Satoshi Tsuruta, Osaka (JP); Shoji Shibata, Chiyoda-ku (JP); Kunihiko Hatabara, Chiyoda-ku (JP); Katsumi Fujino, Chiyoda-ku (JP)

(73) Assignee: NAKATA MANUFACTURING CO., LTD., Osaka-shi (JP)

( * ) Notice: Subject to any disclaimer, the term of this patent is extended or adjusted under 35 U.S.C. 154(b) by 102 days.

(21) Appl. No.: 14/112,814

(22) PCT Filed: Jul. 29, 2011

(86) PCT No.: PCT/JP2011/067464

§ 371 (c)(1),
(2), (4) Date: Jan. 22, 2014

(87) PCT Pub. No.: WO2012/144090

PCT Pub. Date: Oct. 26, 2012

(65) Prior Publication Data

US 2014/0130562 A1 May 15, 2014

(30) Foreign Application Priority Data

Apr. 18, 2011 (JP) ..... 2011-091994

(51) Int. Cl.
*B21B 31/14* (2006.01)
*B21B 13/00* (2006.01)
(Continued)

(52) U.S. Cl.
CPC ..... *B21B 31/14* (2013.01); *B21B 13/001* (2013.01); *B21C 37/0811* (2013.01); *B21C 37/0822* (2013.01); *B21D 5/12* (2013.01)

(58) Field of Classification Search
CPC B21C 37/08; B21C 37/0811; B21C 37/0826; B21D 5/12; B23K 2201/06; B21B 31/10; B21B 35/14; B23B 5/16; C21D 9/08; C21D 9/50
See application file for complete search history.

(56) References Cited

U.S. PATENT DOCUMENTS 5,016,806 A * 5/1991 Yapp et al. ..... 228/147
5,192,013 A * 3/1993 Abbey et al. ..... 228/13
(Continued)

FOREIGN PATENT DOCUMENTS

JP 60 160927 10/1985
JP 6-85715 U 12/1994
(Continued)

OTHER PUBLICATIONS

International Search Report Issued Oct. 11, 2011 in PCT/JP11/067464 Filed Jul. 29, 2011.

*Primary Examiner* — Peter DungBa Vo
*Assistant Examiner* — John S Lowe
(74) *Attorney, Agent, or Firm* — Oblon, McClelland, Maier & Neustadt, L.L.P.

(57) ABSTRACT

A squeeze roll stand includes a combination of a fixed portion installed at a joint position of an electric resistance welded pipe manufacturing line, in which squeeze rolls excluding left and right upper rolls are detachably assembled, and a movable portion overlying the fixed portion, inside which left and right upper rolls are detachably assembled, the movable portion being inclined, taking a back surface downstream side as a fulcrum point, toward a same side from an assembling position on the fixed portion to a retreat position to open an upper part of the fixed portion. The movable portion is driven and reciprocated between the assembling position and the retreat position with cylinder type actuators as a drive mechanism. At the retreat position, the movable portion overlies a bead grinding device arranged on the back surface downstream side of the fixed portion with a front surface facing upward.

11 Claims, 7 Drawing Sheets

Figure 1:
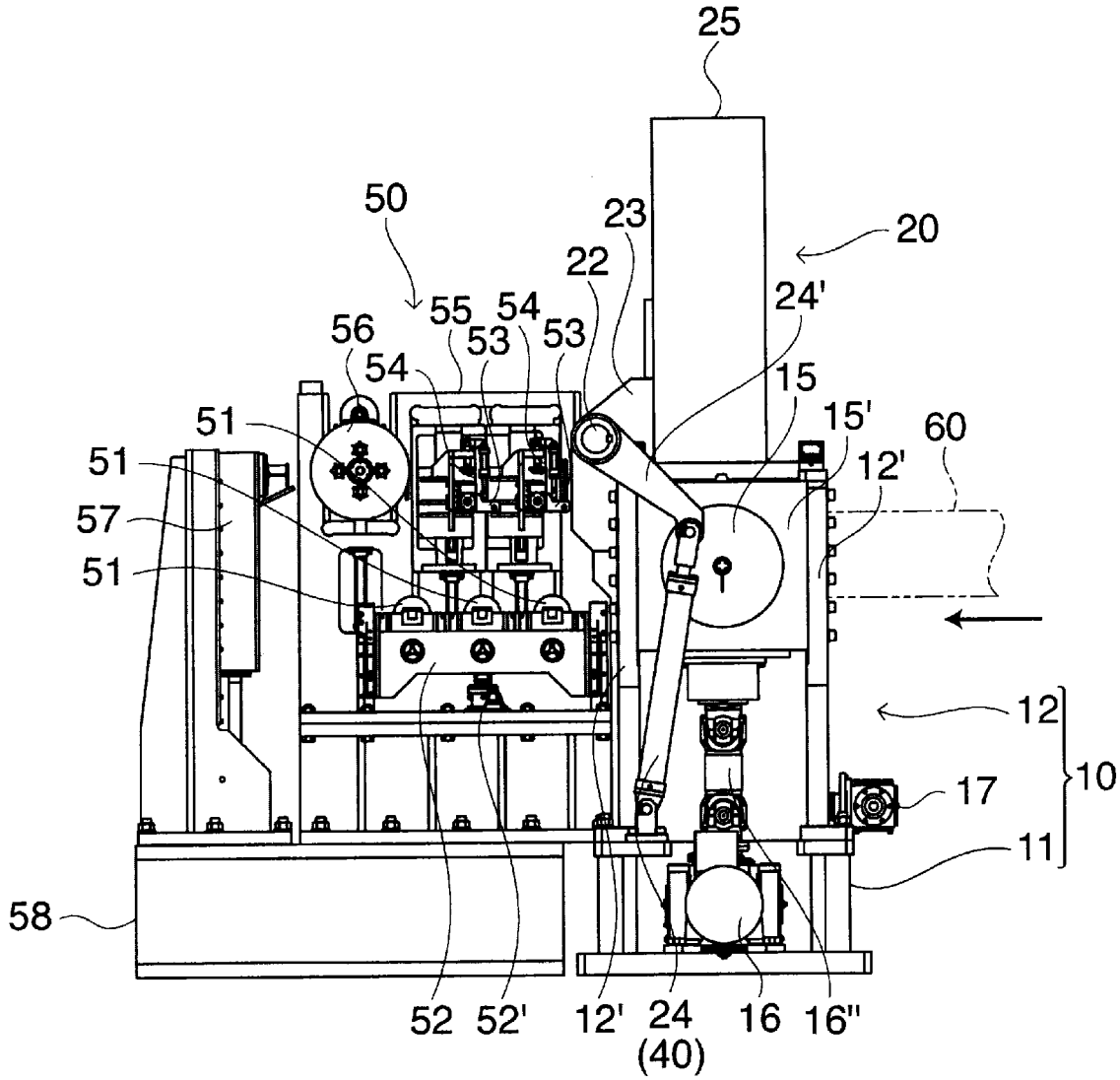

(51) Int. Cl.
*B21C 37/08* (2006.01)
*B21D 5/12* (2006.01)

(56) References Cited

U.S. PATENT DOCUMENTS

| | | | | |
|---|---|---|---|---|
| 5,301,869 | A * | 4/1994 | Toyooka et al. | 228/147 |
| 5,461,896 | A * | 10/1995 | Abbey et al. | 72/181 |
| 7,188,502 | B2 * | 3/2007 | Heimann | 72/239 |
| 2005/0006351 | A1 | 1/2005 | Heimann | |

FOREIGN PATENT DOCUMENTS

| | | | |
|---|---|---|---|
| JP | 10-58194 | A | 3/1998 |
| JP | 3053534 | B2 | 6/2000 |
| JP | 2001-150189 | A | 6/2001 |
| JP | 2005 511306 | | 4/2005 |
| JP | 2006-88215 | A | 4/2006 |
| JP | 4250848 | B2 | 4/2009 |
| JP | 4461549 | B2 | 5/2010 |

* cited by examiner

SQUEEZE ROLL STAND

TECHNICAL FIELD

The present invention relates to a squeeze roll stand arranged at a joint position of an electric resistance welded pipe manufacturing line, and more particularly, to a squeeze roll stand in which a roll replacement work of squeeze rolls is easily performed.

BACKGROUND ART

In an electric resistance welded pipe manufacturing line, a band shape material called a skelp is gradually formed into a cylindrical shape, and continuously welded and jointed by heating a butt edge portion and pressing the heated butt edge portion with squeeze rolls, so that an electric resistance welded pipe with a circular section serving as a product is continuously manufactured. In such an electric resistance welded pipe manufacturing line, various types of products having different sizes are commonly manufactured, and for this, roll replacement for changing size of forming rolls is frequently performed.

Regarding this roll replacement, it is unexceptional also in a squeeze roll stand installed at a joint position of the electric resistance welded pipe manufacturing line, and squeeze rolls are replaced in accordance with size of a product to be manufactured. A method thereof is as follows. As the squeeze rolls in the squeeze roll stand, there are provided a lower roll for supporting an open pipe coming in with a facing edge portion facing upward from the lower side, a pair of left and right side rolls for pressing the open pipe from both sides, and a pair of left and right upper rolls for pressing a vicinity part of the facing edge portion from the obliquely upper side. In the roll replacement, all these rolls are replaced with rolls corresponding to size of a new product. However, at the time of replacing the lower roll and the left and right side rolls, the upper rolls get in the way. Therefore, in the roll replacement of the squeeze rolls, there is a need for detaching the upper rolls before replacement of the lower roll and the left and right side rolls.

However, detachment of the upper rolls is conventionally performed by suspending an upper roll assembly by a crane and separating the upper roll assembly from a stand main body on the lower side. The upper roll assembly separated from the stand main body is conveyed to off-line. After replacement of the upper rolls is performed here, the entire upper roll assembly is returned in place. While the upper roll assembly is detached, the replacement of the side rolls and the lower roll in the stand main body is performed.

Since a roll replacement work in the squeeze roll stand is extensive and troublesome as described above, various improvement measures are proposed in Patent Documents 1 to 3. However, since the measures are basically separation by a suspending work of the upper roll assembly, such a great effect as to expect is not obtained in a current situation. That is, in a case of the separation by the suspending work of the upper roll assembly, the work itself is extensive and troublesome. Besides, there are many problems such as a need for a lot of time for detaching wires and pipes connected to the upper roll assembly from an exterior at each time of the work and for resuming after the work. Thus, productivity is remarkably lowered.

Regarding a material made to be a pipe after finishing welding in the squeeze roll stand, an outer surface welding bead is generally removed by a bead grinding device continuously provided on the downstream side of the squeeze roll stand (refer to Patent Documents 4 to 7). That is, the squeeze roll stand is commonly combined with the bead grinding device on the line downstream side. In the bead grinding device, height of a grinding blade supported on the line is adjusted in accordance with product size. A height adjustment mechanism is also provided on the line together with the grinding blade.

PRIOR ART DOCUMENTS

Patent Documents

Patent document 1: Japanese Patent No. 3053534
Patent document 2: Japanese Patent No. 4250848
Patent document 3: Japanese Patent No. 4461549
Patent document 4: Japanese Unexamined Patent Application Publication No. 10-58194
Patent document 5: Japanese Unexamined Patent Application Publication No. 2001-150189
Patent document 6: Japanese Unexamined Patent Application Publication No. 2006-88215
Patent document 7: Japanese Unexamined Utility Model Application Publication No. 6-85715

DISCLOSURE OF THE INVENTION

Problems to be Solved by the Invention

An object of the present invention is to provide a squeeze roll stand in which roll replacement of squeeze rolls is easily performed and a device structure is simple.

Means for Solving the Problems

In order to achieve the above object, a squeeze roll stand of the present invention includes: a fixed portion installed at a joint position of an electric resistance welded pipe manufacturing line, in which squeeze rolls excluding left and right upper rolls are detachably assembled; a movable portion overlying the fixed portion, inside which the left and right upper rolls are detachably assembled, the movable portion being inclined, taking at least one direction side as a fulcrum point, toward the side from an assembling position on the fixed portion to a retreat position to open an upper part of the fixed portion; a lock mechanism for fixing the movable portion at the assembling position on the fixed portion; and a drive mechanism for driving and reciprocating the movable portion between the assembling position and the retreat position; in which the fixed portion is combined with a bead grinding device installed on the line downstream side, and the movable portion is inclined toward the downstream side of the electric resistance welded pipe manufacturing line, and overlies the bead grinding device in a state that the movable portion is inclined toward the line downstream side.

In the squeeze roll stand of the present invention, the movable portion serving as an upper roll assembly for accommodating the upper rolls among the squeeze rolls is coupled to the fixed portion for accommodating the other squeeze rolls, and by being inclined from the assembling position on the fixed portion to the retreat position on the one direction side, open the upper part of the fixed portion so as to bring a state that roll replacement can be performed. Thus, in comparison to a conventional type in which an upper roll assembly is suspended by a crane to be separated and removed, a roll replacement operation is extremely easy.

The inclination direction of the movable portion is the downstream side of the electric resistance welded pipe manufacturing line. In a case where the movable portion is inclined toward the line side, a movable portion receiving space is separately required on the line side. Meanwhile, in a case where the movable portion is inclined toward the upstream side or the downstream side of the electric resistance welded pipe manufacturing line, a space on the upper side of the line can rationally be utilized as the movable portion receiving space. In particular, since the bead grinding device exists on the downstream side of the electric resistance welded pipe manufacturing line, the movable portion is inclined toward the line downstream side. In such a way, the movable portion inclined toward the line downstream side can overlie the bead grinding device on the downstream side. When this position serves as the retreat position, an upper space of the bead grinding device can be effectively utilized, so that an increase of an occupation area in device can be avoided. The bead grinding device can be utilized as a support body at the retreat position of the movable portion, so that a device configuration can be simplified.

In order to make an upper part of the bead grinding device the retreat position of the movable portion, there is a need for limiting height of the bead grinding device in such a manner that the movable portion is inclined at right angle toward the line downstream side. When the height of the bead grinding device is larger than this, an inclination angle of the movable portion becomes short, and the upper part of the fixed portion is not completely opened. In order to limit the height of the bead grinding device, a height adjustment mechanism of a grinding part and a height adjustment mechanism of a support roll originally arranged on the upper side of the grinding part in the bead grinding device are rationally and preferably arranged on the line side or the lower side.

Regarding the lock mechanism for fixing the movable portion at the assembling position on the fixed portion, a combination of plate shape stoppers protruding from a lower end of the movable portion toward the front surface side and the back surface side, the plate shape stoppers being respectively engaged with an edge (front edge) on the front surface side and an edge (rear edge) on the back surface side of an upper surface of the fixed portion, and a plurality of clamps attached to the edge on the front surface side and the edge on the back surface side of the upper surface of the fixed portion for fixing plate shape stopper engagement parts from both sides is preferable for a simple structure.

The plate shape stoppers here can also serve as support members of the movable portion. In such a way, a structure can be furthermore simplified.

Preferably, the plurality of clamps are arranged equally on both left and right sides, and always presses the plate shape stoppers with a load which is not less than a forming reaction force in the squeeze roll stand. With this configuration, backlash of the plate shape stopper engagement parts can be suppressed to minimum, so that a highly rigid squeeze roll stand can be manufactured.

Left and right side rolls in the fixed portion may be detachably coupled to left and right drive shafts arranged on the lower side via left and right insertion type couplings, and positions of the left and right insertion type couplings may be adjustable in the lateral direction at right angle to the line. At the time of attaching the left and right side rollers, by preliminarily adjusting the positions of the left and right insertion type couplings with this configuration, the left and right side rollers and the left and right drive shafts can be easily coupled.

The left and right drive shafts here preferably include universal joints for allowing lateral movement of the left and right insertion type couplings.

Effect of the Invention

In the squeeze roll stand of the present invention, the movable portion serving as the upper roll assembly for accommodating the upper rolls among the squeeze rolls opens the upper part of the fixed portion by being inclined relatively to the fixed portion for accommodating the other squeeze rolls. Thus, not only an operation of separating the movable portion from the fixed portion at the time of roll replacement of the squeeze rolls, an operation of suspending the movable portion after separation by a crane and carrying out of the line, an operation of returning to the original place, and an operation of re-combining the movable portion with the fixed portion are not required any more, but also attachment and detachment works for wires and pipes are not required any more. Therefore, a roll replacement operation becomes enormously simple. Further, the fixed portion is inclined while leaving a set trail, so that a positioning mechanism and a guide mechanism become extremely simple and a suspending crane is not required any more. In consideration with the above and the like, the device structure can also be simplified.

BRIEF DESCRIPTIONS OF THE DRAWINGS

FIG. 1 A side view of a squeeze roll stand showing one embodiment of the present invention.

Figure 2:
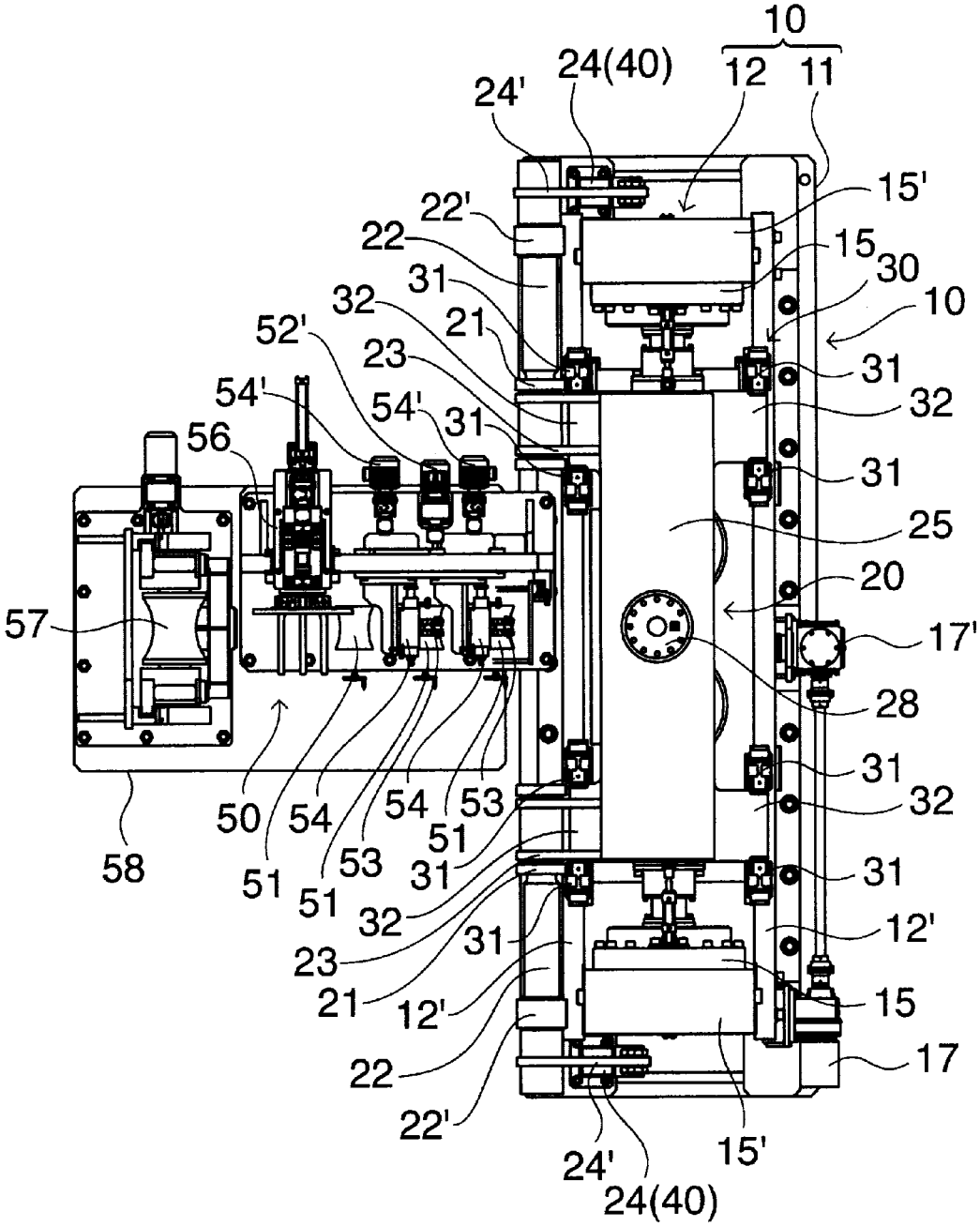

FIG. 2 A plan view of the same squeeze roll stand.

Figure 3:
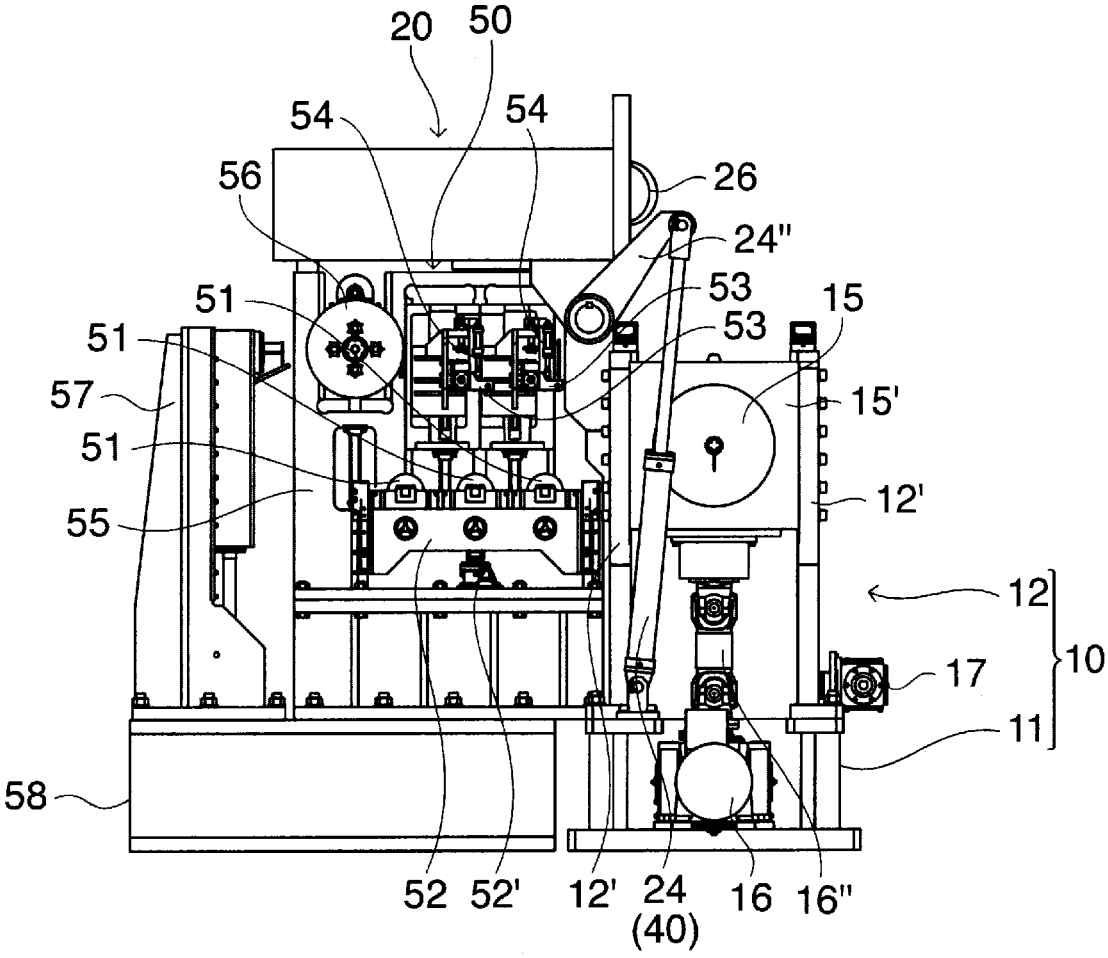

FIG. 3 A side view showing an action of the same squeeze roll stand.

Figure 4:
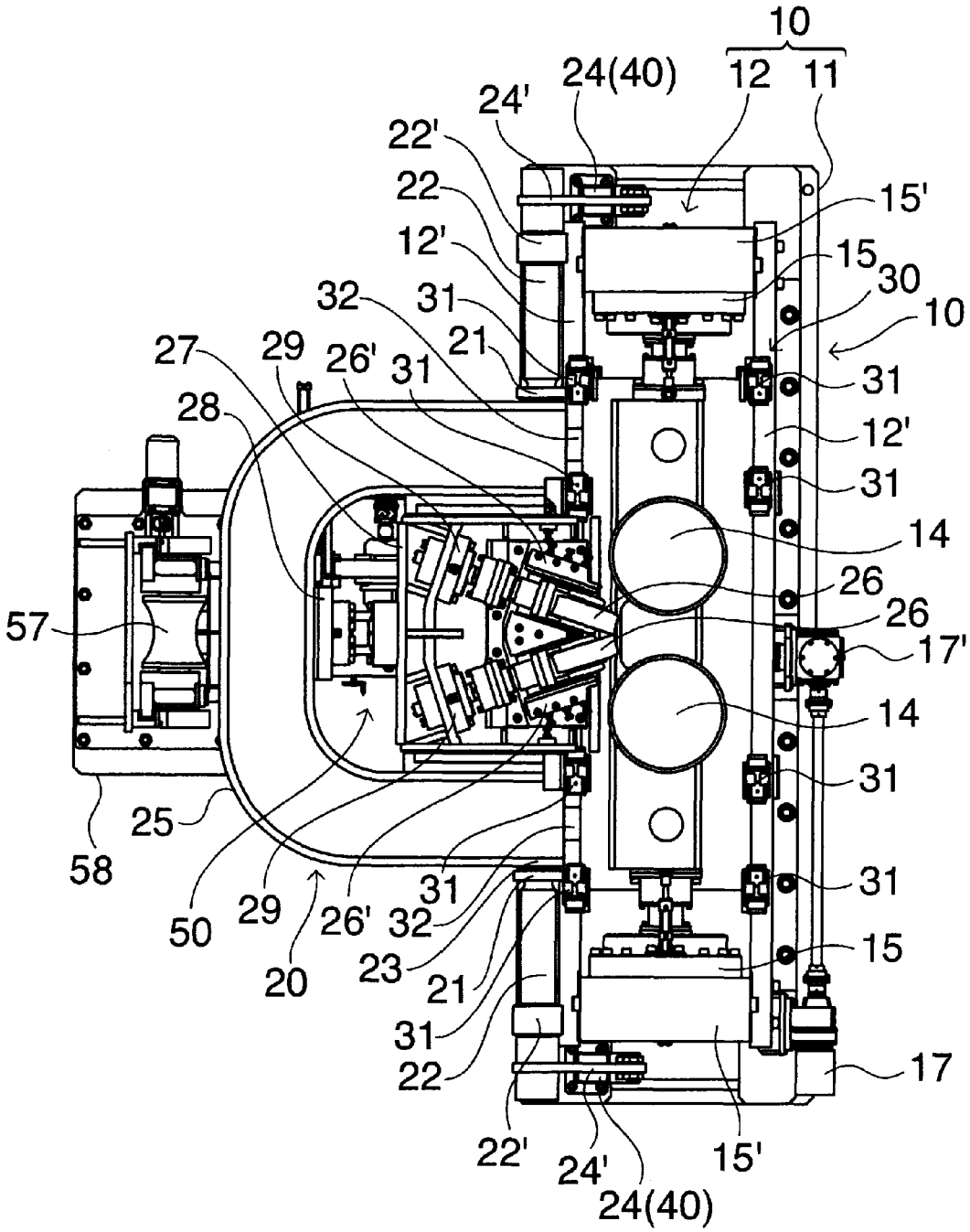

FIG. 4 A plan view showing an action of the same squeeze roll stand.

Figure 5:
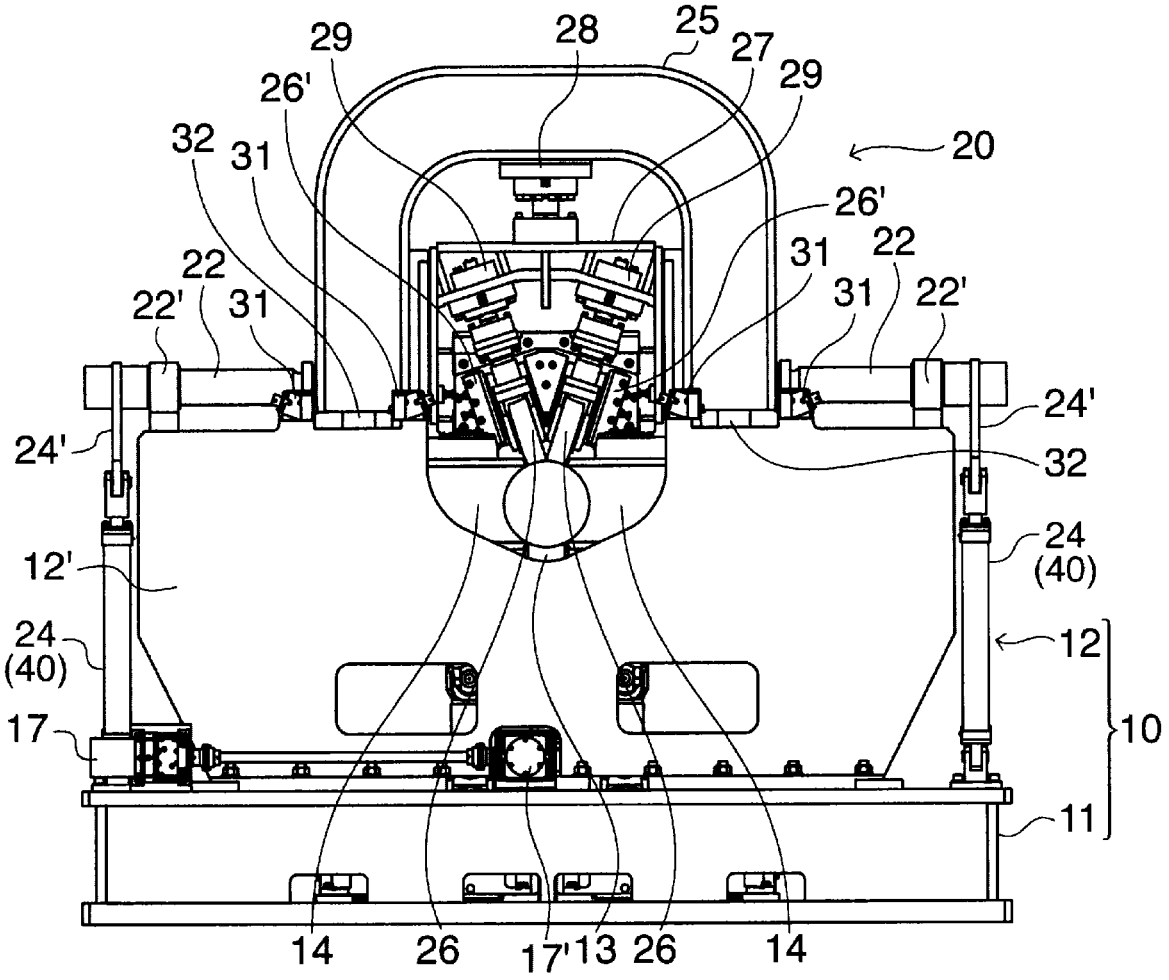

FIG. 5 A front view of the same squeeze roll stand.

Figure 6:
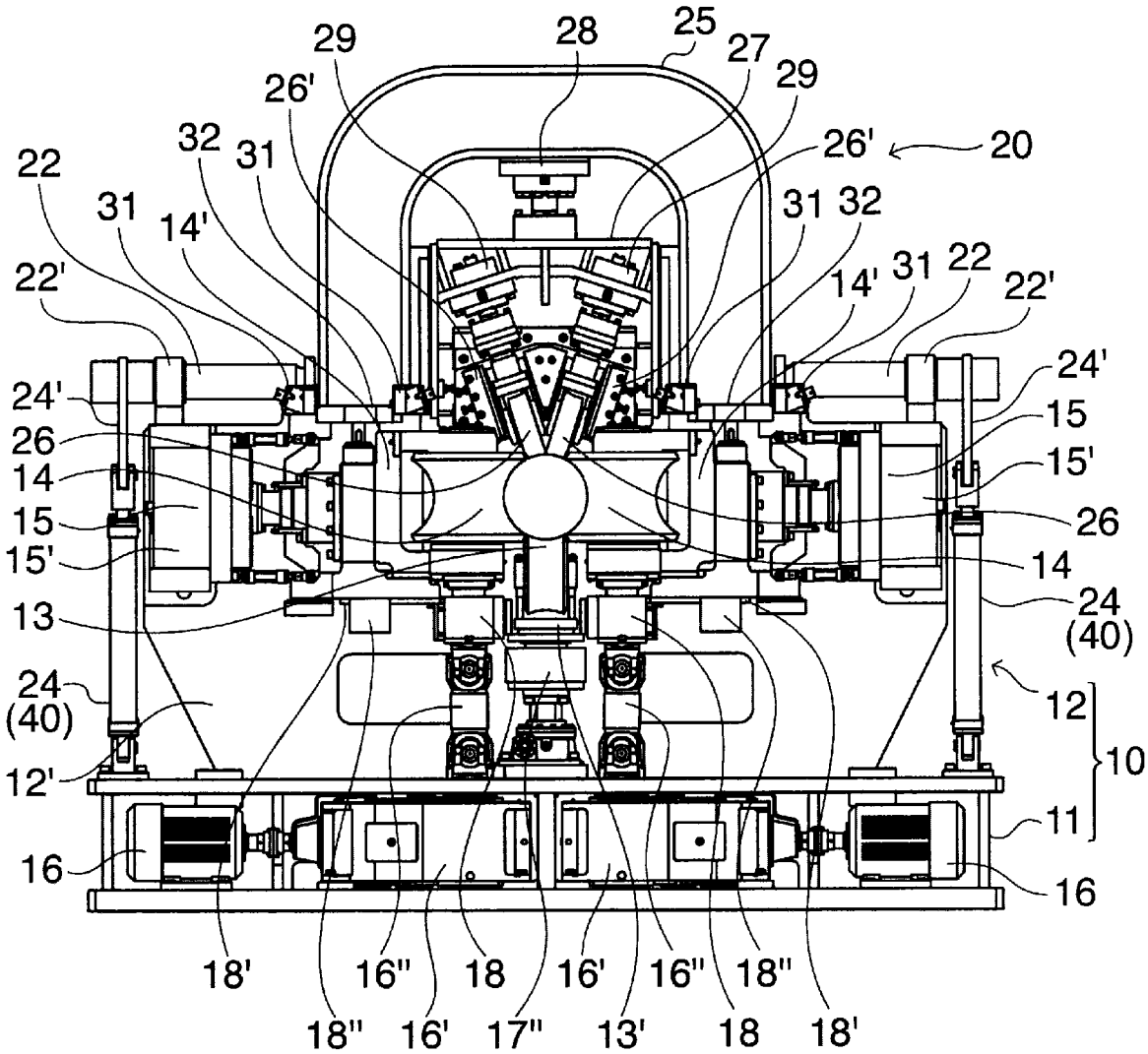

FIG. 6 A front view showing an internal structure of the same squeeze roll stand.

Figure 7:
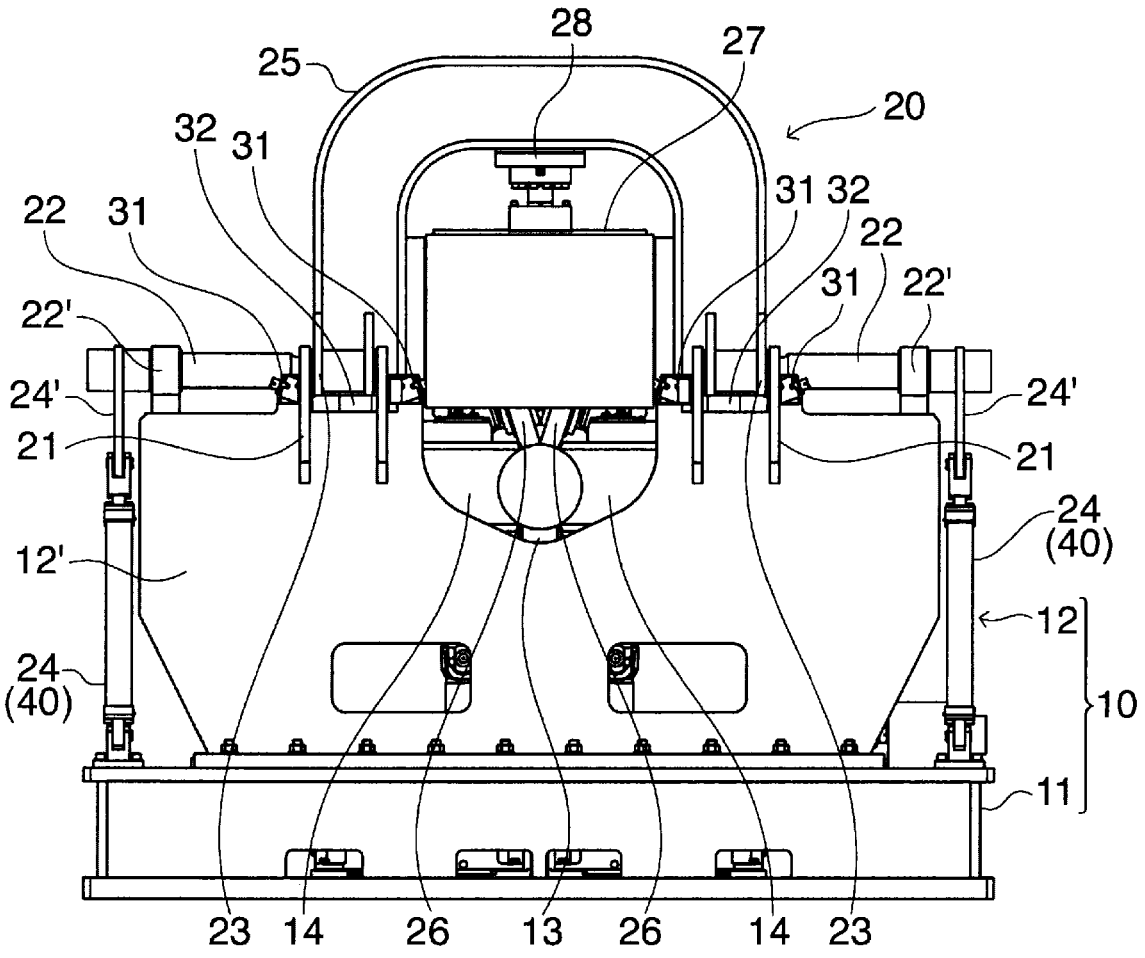

FIG. 7 A back view of the same squeeze roll stand.

BEST MODE FOR CARRYING OUT THE INVENTION

Hereinafter, one embodiment of the present invention will be described.

A squeeze roll stand of the present embodiment is, as shown in FIGS. 1 to 4, installed particularly at a joint position of an electric resistance welded pipe manufacturing line, to joint a facing edge portion of an open pipe 60 passing through a forming roller group (not shown) and coming in with the facing edge portion facing upward. This squeeze roll stand includes a fixed portion 10 installed at the joint position of the manufacturing line, an inclination type movable portion 20 overlying the fixed portion 10, a lock mechanism 30 for fixing the movable portion 20 onto the fixed portion 10, and a drive mechanism 40 for driving and inclining the movable portion 20, and is combined with a bead grinding device 50 installed on the line downstream side of the squeeze roll stand.

The fixed portion 10 of the squeeze roll stand includes a base 11, and a stand main body 12 continuously provided on the base as shown in FIGS. 5 and 6.

In the stand main body 12 of the fixed portion 10, as squeeze rolls, a lower roll 13 for supporting the open pipe 60 from the lower side, and left and right side rolls 14, 14 for pressing the open pipe 60 from both sides are provided. The lower roll 13 is a horizontal free roller rotatably supported by a bracket 13' on the lower side.

The left and right side rolls 14, 14 are vertical rolls rotatably supported by cantilever type support bodies 14', 14' whose support sides are directed to the outer sides. The support bodies 14', 14' on both the sides are driven in the horizontal direction at right angle to the line by hydraulic servo control cylinders 15, 15 provided on both sides of the support bodies. Thereby, a pressing amount of the left and right side rolls 14, 14 is adjusted. The stand main body 12 includes cylinder cases 15', 15' of the hydraulic servo control cylinders 15, 15 on both the sides and detachable front and rear frame panels 12', 12'. An upper surface of the stand main body 12 is substantially entirely opened except front and rear edges and left and right edges (refer to FIG. 4).

In the base 11 of the fixed portion 10, a pair of left and right first motors 16, 16 for driving and rotating the side rolls 14, 14 in the stand main body 12 is installed. On the base 11, a second motor 17 for driving, elevating, and lowering the lower roll 13 in the stand main body 12 is mounted.

The first motors 16, 16 are arranged on both side ends in the base 11 in such a manner that output shafts are directed to the inner side. Since rotations of each output shaft are respectively transmitted to the side rolls 14, 14 on the upper side via gear boxes 16', 16' arranged on the respective inner sides, a pair of left and right drive shafts 16", 16" vertically arranged in the stand main body 12, and a pair of left and right insertion type couplings 18, 18 attached on the upper side of those members, the side rolls 14, 14 are driven and rotated in synchronization.

The left and right insertion type couplings 18, 18 here are secured to upper ends of the drive shafts 16", 16", and by inserting coupling pins protruding downward from lower ends of the side rolls 14, 14, couple the side rolls 14, 14 detachably. The insertion type couplings 18, 18 are movably supported in the lateral direction by horizontal guides 18', 18' at right angle to the line, and guided to arbitrary lateral positions by motor type jacks 18", 18". The drive shafts 16", 16" include universal joints for allowing lateral movement of the insertion type couplings 18, 18, that is, a change in the pressing amount of the side rolls 14, 14.

The second motor 17 is mounted on a side edge on the front surface side (line upstream side) of the base 11 in such a manner that an output shaft is directed to the inner side. The output shaft of the second motor 17 adjusts height of the lower roll 13 by driving, elevating, and lowering, via a gear box 17' mounted on a center part on the front surface side (line upstream side) of the base 11, the gear box for changing the direction, and a jack 17" arranged in the stand main body 12, the bracket 13' on the upper side of the gear box and the jack.

The movable portion 20 on the fixed portion 10 includes, as shown in FIGS. 5 to 7, an arch shape frame 25 having a reversed U shape when seen in a front view, and a pair of left and right upper rolls 26, 26 elevatably and lowerably supported in the frame 25. The inner side of the arch shape frame 25 is opened downward. The upper rolls 26, 26 are the same free rollers as the lower roll 13, arranged while being slightly inclined inward so as to press both edge portions of the open pipe 60 coming in with the facing edge portion facing upward from the obliquely upper side. In order to press both the edge portions of the open pipe 60, the upper rolls 26, 26 are attached in a movable base 27 elevatably and lowerably provided in the frame 25.

A detailed description will be given. The movable base 27 is driven, elevated, and lowered by a hydraulic servo control cylinder 28 attached to a center part of the frame 25. A pair of left and right hydraulic servo control cylinders 29, 29 is attached downward to the movable base 27, and guides 26', 26' positioned on the lower side of the cylinders for guiding the upper rolls 26, 26 are provided. The hydraulic servo control cylinders 29, 29 and the guides 26', 26' are slightly inclined inward corresponding to inclination of the upper rolls 26, 26. By an elevating and lowering operation of the movable base 27 with the hydraulic servo control cylinder 28 and an elevating and lowering operation of the upper rolls 26, 26 with the hydraulic servo control cylinders 29, 29, height of the upper rolls 26, 26 is independently adjusted.

The movable portion 20 is also formed to be pivoted by about 90 degrees toward the back surface side (line downstream side) of the fixed portion 10 taking an upper end of the back surface side (line downstream side) of the fixed portion 10 as a center. For this pivoting, the movable portion 20 has a pair of left and right first brackets 21, 21 secured to an upper end on the back surface side (line downstream side) of the fixed portion 10, a pair of left and right rotation shafts 22, 22 horizontally supported by the first brackets 21, 21, and a pair of left and right second brackets 23, 23 secured to a lower end on the back surface side (line downstream side) of the pivoting portion 20.

The left and right second brackets 23, 23 secured to the lower end on the back surface side (line downstream side) of the pivoting portion 20 are respectively arranged on each inner side of the left and right first brackets 21, 21, and secured to the rotation shafts 22, 22. Front ends of a pair of left and right levers 24', 24' secured to both ends of the rotation shafts 22, 22 are axially attached to rod front ends of actuators 24, 24 including a pair of left and right cylinders which is axially supported on both ends on the back surface side (line downstream side) of the base 11.

When the movable portion 20 is at an assembling position on the fixed portion 10, rods of the actuators 24, 24 are retreated. By extending the rods of the actuators 24, 24 from this state, the movable portion 20 is inclined by about 90 degrees toward the back surface side (line downstream side) taking the horizontal rotation shafts 22, 22 on the back surface side (line downstream side) as a center, so as to be mounted on a bead grinding device 50 arranged on the back surface side (line downstream side) with a front surface facing upward.

The actuators 24, 24 here are the drive mechanism 40 for driving and inclining the movable portion 20. An upward facing state is a retreat position of the movable portion 20, in which the movable portion 20 is inclined by about 90 degrees toward the back surface side (line downstream side) and mounted on the bead grinding device 50 arranged on the back surface side (line downstream side) with the front surface facing upward. The reference numerals 22', 22' denote axial support parts for pivotably supporting the left and right rotation shafts 22, 22 on the inner sides of the levers 24', 24'.

The lock mechanism 30 for fixing the movable portion 20 onto the fixed portion 10 includes a combination of a plurality of (herein, eight) clamps 31 provided on an upper surface of the fixed portion 10 as shown in FIGS. 2 and 4. Four of the eight clamps 31 are attached onto an upper surface of an edge (front edge) on the front surface side of the fixed portion 10 as two pairs of two clamps, and the remaining four clamps are attached onto an upper surface of an edge (rear edge) on the back surface side of the fixed portion 10 as two pairs of two clamps. The two pairs of clamps 31 attached onto the upper surface of the front edge are arranged on both sides of a center part, and the two clamps 31, 31 in each pair are arranged to face each other. Similarly, the two pairs of clamps 31 attached onto the upper surface of the rear edge are arranged on both sides of a center part, and the two clamps 31, 31 in each pair are arranged to face each other.

The four pairs of (eight) clamps 31 restraint plate shape stoppers 32, 32 on both sides protruding forward and rearward from both lower ends of the frame 25 in the movable portion 20 so as to fix onto the fixed portion 10 when the movable portion 20 is at the assembling position on the fixed portion 10. Specifically, each end of the two plate shape stoppers 32, 32 protruding from both the lower ends of the frame 25 toward the upstream side, and ends of the two plate shape stoppers 32, 32 protruding toward the downstream side are engaged with an upper part of the front edge and an upper part of the rear edge of the fixed portion 10, so that the movable portion 20 is supported on the fixed portion 10.

By respectively locking each end of the plate shape stoppers 32,32 protruding toward the upstream side by the two pairs of clamps 31 on the front edge side from both sides in a state that the each end is mounted on the front edge of the fixed portion 10, and by respectively locking each end of the plate shape stoppers 32, 32 protruding toward the downstream side by the two pairs of clamps 31 on the rear edge side from both sides in a state that the each end is mounted on the rear edge of the fixed portion 10, the movable portion 20 is supported and fixed onto the fixed portion 10. Each of the two plate shape stoppers 32, 32 on the front or rear side also serve as support members of the movable portion 20.

The above eight clamps 31 are a hydraulic type here, and by making a clamp force by those clamps, that is, a force of fixing the plate shape stoppers 32, 32 on both the sides protruding forward and rearward onto the fixed portion 10 by the eight clamps 31, not less than a load generated in an engagement fixed part at the time of forming the pipe, backlash of the engagement fixed part is suppressed to minimum, so that the squeeze roll stand becomes highly rigid.

As shown in FIGS. 1 to 4, height of the bead grinding device 50 continuously provided on the downstream side of the fixed portion 10 is limited so as to allow inclination of the movable portion 20 to the retreat position on the downstream side of the electric resistance welded pipe manufacturing line, and also to serve as a support body of the movable portion 20 on the lower side of the movable portion 20 inclined to the retreat position. Due to this height limitation, the bead grinding device 50 inherently adopts the following configuration.

As shown in FIGS. 1 to 4, the bead grinding device 50 has a main frame 55 arranged on the downstream side of the fixed portion 10, a plurality of support rollers 51 provided in the main frame 55 so as to be spaced from each other in the line longitudinal direction for supporting a pipe shape material coming out from the squeeze roll stand, and a plurality of (herein, two) grinding blades 53 provided in the main frame 55 so as to be positioned on the upper side of the support rollers 51.

The plurality of support rollers 51 are attached to an elevatable and lowerable common support frame 52, and their heights are collectively adjusted by driving, elevating, and lowering the support frame 52 with a motor jack 52' provided on the line side. The plurality of grinding blades 53 arranged together with the plurality of support rollers 51 so as to be spaced from each other in the line longitudinal direction are attached to individual elevation and lowering frames 54. By being individually driven, elevated, and lowered with a plurality of motor jacks 54' provided in correspondence with each elevation and lowering frame on the line side, the plurality of elevation and lowering frames 54 individually adjust height of the plurality of grinding blades 53. The plurality of elevation and lowering frames 54 for individually supporting the plurality of grinding blades 53 are respectively provided with position adjustment mechanisms for adjusting circumferential positions of the grinding blades 53.

In such a way, by arranging the motor jack 52' serving as a height adjustment mechanism of the plurality of support rollers 51 and the plurality of motor jacks 54' serving as height adjustment mechanisms of the plurality of elevation and lowering frames 54 on the side of the electric resistance welded pipe manufacturing line (pipe material passage line), the height of the bead grinding device 50 is decreased to such a level that the movable portion 20 can be inclined by about 90 degrees toward the downstream side.

In the main frame 55 of the bead grinding device 50, a bead winder unit 56 is arranged so as to be positioned on the further downstream side of the plurality of grinding blades 53, and a support upper roll unit 57 is arranged on the further downstream side of the main frame 55. The support upper roll unit 57 is installed on a base 58 arranged on the downstream side of the squeeze roll stand together with the main frame 55.

An upper part of the main frame 55 of the bead grinding device 50 is opened. Since the movable portion 20 does not overlie this upper part during operation, the part becomes in an opened state. As a result, a mode without fume retention that is also preferable in terms of a working environment is obtained.

The structure of the squeeze roll stand of the present embodiment is described above. Hereinafter, functions of the squeeze roll stand of the present embodiment will be described mainly based on FIGS. 1 to 4.

During operation, as shown in FIGS. 1 and 2, the movable portion 20 of the squeeze roll stand is fixed at the assembling position on the fixed portion 10 by the lock mechanism 30. Thereby, the squeeze rolls in the squeeze roll stand, that is, the lower roll 13 and the left and right side rolls 14, 14 in the fixed portion 10, and the pair of left and right upper rolls 26, 26 in the movable portion 20 exist at fixed positions. By actuating the pair of left and right first motors 16, 16 provided in the base 11 of the fixed portion 10, the left and right side rolls 14, 14 in the fixed portion 10 are driven and rotated.

In advance, the height of the lower roll 31 in the fixed portion 10 is adjusted by the second motor 17 on the base 11, the pressing amount of the left and right side rolls 14, 14 is adjusted by the hydraulic servo control cylinders 15, 15, the lateral positions of the insertion type couplings 18, 18 are adjusted by the motor type jacks 18", 18", and the height of the upper rolls 26, 26 in the movable portion 20 is adjusted by the hydraulic servo control cylinder 28.

In the bead grinding device 50, the height of the plurality of support rollers 51 is adjusted by the motor jack 52', and the height of the plurality of grinding blades 53 is adjusted by the plurality of motor jacks 54'.

The open pipe 60 comes into the squeeze roll stand with the facing edge portion facing upward, and the facing edge portion is jointed by heating with a heating device (not shown), pressing with the left and right side rolls 14, 14, and depressing with the left and right upper rolls 26, 26. The pipe shape material after finishing jointing successively comes into the bead grinding device 50 on the downstream side, and by stepwise removing an outer surface bead generated in joint parts by the plurality of grinding blades 53, becomes an electric resistance welded pipe with a circular section serving as a product. The clamp force by the eight clamps 31 in the lock mechanism 30 is set to not less than a forming load reaction force. Thus, backlash of engagement parts is suppressed to minimum and rigidity of the squeeze roll stand is enhanced as described above.

When size of an electric resistance welded pipe to be manufactured is changed, the squeeze rolls in the squeeze roll stand are replaced. At the time of roll replacement of the squeeze rolls, firstly, in a state that rotation of the side rolls 14, 14 is stopped, the eight clamps 31 in the lock mechanism 30 are actuated in the open direction. Thereby, the plate shape stoppers 32, 32 on both the sides in the movable portion 20, the plate shape stoppers being bridged to the front edge and to the rear edge in the uppermost part of the fixed portion 10 are respectively released from the front edge and the rear edge.

When the lock mechanism 30 is canceled in such a way, the hydraulic cylinder type actuators 24, 24 on both the sides of the fixed portion 10, the actuators serving as the drive mechanism 40 of the movable portion 20 are switched from a rod withdrawing state to a rod advancing state. Thereby, the pair of left and right levers 24', 24' secured to both the ends of the rotation shafts 22 are pushed, so that the rotation shafts 22 are pivoted in the direction in which the movable portion 20 is pivoted to the back surface side (line downstream side) taking the rotation shaft 22 on the back surface side (line downstream side) as a fulcrum point. At the end, the movable portion 20 is inclined by about 90 degrees until overlying the frame 55 of the bead grinding device 50 on the back surface side (line downstream side). This is a state shown in FIGS. 3 and 4.

Since the movable portion 20 on the fixed portion 10 in the squeeze roll stand is inclined by about 90 degrees toward the back surface side (line downstream side) taking the rotation shaft 22 on the back surface side (line downstream side) as a fulcrum point, so as to overlie the bead grinding device 50 on the back surface side (line downstream side) with the front surface facing upward, the upper surface of the fixed portion 10 is opened. The inside of the arch shape frame 25 in the movable portion 20 is opened. Thereby, the left and right side rolls 14, 14 in the fixed portion 10 are simply replaced. In a case where replacement of the lower roll 13 is required, the replacement is also easily performed. Further, in a case where replacement of the left and right upper rolls 26, 26 in the movable portion 20 is required, the replacement is also easily performed.

Further, in the fixed portion 10, one or both of the front and rear frame panels 12', 12' can be detached. Thereby, a front surface and/or a rear surface of the fixed portion 10 are opened. Thus, the replacement of the squeeze rolls in the fixed portion 10 is furthermore easily performed.

That is, in the squeeze roll stand of the present embodiment, at the time of performing the roll replacement, the movable portion 20 serving as an upper roll assembly can be inclined toward the line downstream side relatively to the fixed portion 10 below the movable portion, and the movable portion 20 is retreated from an upper part of the fixed portion 10 by an inclination operation thereof. Thus, in comparison to a case where the upper roll assembly is suspended by a crane and separated and retreated from the fixed portion 10 therebelow, a retreat operation is easy. Since the retreated movable portion 20 overlies the bead grinding device 50 on the line downstream side with the front surface facing upward, there is no need for a temporary installment space out of the line. Moreover, since the frame 55 of the bead grinding device 50 also serves as the support body of the movable portion 20, the configuration is simple. Further, the upper part of the fixed portion 10 after retreat of the movable portion 20 is in an opened state. Therefore, by setting a gate shape frame on the fixed portion 10, or the like, the roll replacement in the fixed portion 10 can be automatically performed. As a method of automatic roll replacement, various methods including use of a small hoist and use of various cylinders can be performed.

At the time of replacing the left and right side rolls 14, 14 in the fixed portion 10, since the side rolls 14, 14 are coupled to the drive shafts 16", 16" on the lower side via the insertion type couplings 18, 18, the side rolls 14, 14 can be separated from the drive shafts 16", 16" only by bringing the side rolls up. At the time of setting the left and right side rolls 14, 14 in accordance with size of a next product, the lateral positions of the insertion type couplings 18, 18 are adjusted by the motor type jacks 18", 18" in accordance with size of those rolls. Thereby, only by setting the left and right side rolls 14, 14 in accordance with the size of the next product at fixed positions from the upper side, the side rolls can be coupled to the drive shafts 16", 16" on the lower side.

It should be noted that in the above embodiment, in order to eliminate the movable portion 20 on the fixed portion 10 in the squeeze roll stand from the upper part of the fixed portion 10, the movable portion 20 is inclined toward the line downstream side taking a horizontal shaft (rotation shaft 22) at right angle to the line on the line downstream side as a fulcrum point. However, the movable portion can also be inclined toward the line upstream side taking a horizontal shaft at right angle to the line on the line upstream side as a fulcrum point, or the movable portion can also be inclined toward the line side taking a horizontal shaft parallel to the line on the line side as a fulcrum point. Further, the movable portion can also be inclined in two steps taking two shafts of the horizontal shaft at right angle to the line on the line downstream side and the horizontal shaft parallel to the line on the line side as fulcrum points.

EXPLANATION OF REFERENCE NUMERALS

10: Fixed portion
11: Base
12: Stand main body
13: Lower roll
14: Side roll
15: Hydraulic servo control cylinder
16: First motor
17: Second motor
18: Insertion type coupling
20: Movable portion
21: First bracket
22: Rotation shaft
23: Second bracket
24: Actuator
25: Frame
26: Upper roll
27: Movable base
28: Hydraulic servo control cylinder
29: Hydraulic servo control cylinder
30: Lock mechanism
31: Clamp
32: Plate shape stopper
40: Drive mechanism (actuator 24)
50: Bead grinding device
51: Support roller
52: Support frame
53: Grinding blade
54: Elevation and lowering frame
55: Main frame
56: Bead winder unit
57: Support upper roll unit
58: Base
60: Open pipe

The invention claimed is:

1. A squeeze roll stand comprising:

a fixed portion installed at a joint position of an electric resistance welded pipe manufacturing line, in which squeeze rolls, excluding left and right upper rolls, are detachably assembled;

a movable portion overlying the fixed portion, inside which the left and right upper rolls are detachably assembled, the movable portion being pivoted toward a line downstream side of the fixed portion taking an upper end of the line downstream side of the fixed portion as a center so that the movable portion is tilted from an assembling position on the fixed portion to a retreat position to open an upper part of the fixed portion with the line downstream side as a pivot;

a lock mechanism for fixing the movable portion at the assembling position on the fixed portion; and a drive mechanism for driving and reciprocating the movable portion between the assembling position and the retreat position;

wherein the fixed portion is combined with a bead grinding device installed on the line downstream side, and the movable portion overlies the bead grinding device with a front surface thereof facing upward in a state that the movable portion is tilted toward the retreat position on the line downstream side.

2. The squeeze roll stand according to claim 1, wherein a height of the bead grinding device is limited such that the movable portion is inclined at a right angle toward the line downstream side.

3. The squeeze roll stand according to claim 2, wherein for limiting the height of the bead grinding device, height adjustment mechanisms of a support roll and a grinding part in the bead grinding device are arranged on the line side.

4. A squeeze roll stand comprising:

a fixed portion installed at a joint position of an electric resistance welded pipe manufacturing line, in which squeeze rolls, excluding left and right upper rolls, are detachably assembled;

a movable portion overlying the fixed portion, inside which the left and right upper rolls are detachably assembled, the movable portion being pivoted toward a line downstream side of the fixed portion from an assembling position on the fixed portion to a retreat position to open an upper part of the fixed portion with the line downstream side as a pivot;

a lock mechanism for fixing the movable portion at the assembling position on the fixed portion; and a drive mechanism for driving and reciprocating the movable portion between the assembling position and the retreat position;

wherein the fixed portion is combined with a bead grinding device installed on the line downstream side, and the movable portion overlies the bead grinding device with a front surface thereof facing upward in a state that the movable portion is toward the retreat position on the line downstream side; wherein the lock mechanism includes:

a combination of plate shape stoppers protruding from a lower end of the movable portion toward a front surface side and a back surface side, the plate shape stoppers being respectively engaged with an edge on the front surface side and an edge on the back surface side of an upper surface of the fixed portion; and a plurality of clamps attached to the edge on the front surface side and the edge on the back surface side of the upper surface of the fixed portion for fixing plate shape stopper engagement parts from both sides.

5. The squeeze roll stand according to claim 4, wherein the plate shape stoppers also serve as support members of the movable portion.

6. The squeeze roll stand according to claim 4, wherein the plurality of clamps is arranged equally on both left and right sides, and always presses the plate shape stoppers with a load that is not less than a forming reaction force in the squeeze roll stand.

7. The squeeze roll stand according to claim 1, wherein left and right side rolls in the fixed portion are detachably coupled to left and right drive shafts arranged on a lower side via left and right insertion type couplings, and positions of the left and right insertion type couplings are adjustable in a lateral direction at a right angle to the line.

8. The squeeze roll stand according to claim 7, wherein the left and right drive shafts include universal joints for allowing lateral movement of the left and right insertion type couplings.

9. The squeeze roll stand according to claim 1, wherein the lock mechanism includes:

a combination of plate shape stoppers protruding from a lower end of the movable portion toward a front surface side and a back surface side, the plate shape stoppers being respectively engaged with an edge on the front surface side and an edge on the back surface side of an upper surface of the fixed portion; and a plurality of clamps attached to the edge on the front surface side and the edge on the back surface side of the upper surface of the fixed portion for fixing plate shape stopper engagement parts from both sides.

10. The squeeze roll stand according to claim 9, wherein the plate shape stoppers also serve as support members of the movable portion.

11. The squeeze roll stand according to claim 9, wherein the plurality of clamps is arranged equally on both left and right sides, and always presses the plate shape stoppers with a load that is not less than a forming reaction force in the squeeze roll stand.

* * * * *